US006920740B2

(12) United States Patent
Blake et al.

(10) Patent No.: US 6,920,740 B2
(45) Date of Patent: Jul. 26, 2005

(54) CONTINUOUS BAG CLOSING APPARATUS AND METHOD

(75) Inventors: David J. Blake, Belle Fourche, SD (US); Cory Muhm, Belle Fourche, SD (US)

(73) Assignee: AMCOL International Corporation, Arlington Heights ( * ) Notice: Subject to any disclaimer, the term of this patent is extended or adjusted under 35 U.S.C. 154(b) by 34 days.

(21) Appl. No.: 10/701,903

(22) Filed: Nov. 5, 2003

(65) Prior Publication Data

US 2005/0091943 A1 May 5, 2005

(51) Int. Cl.[7] ..... B65B 51/06

(52) U.S. Cl. ..... 53/469; 53/481; 53/512; 53/138.3; 53/284.7; 53/385.1; 53/386.1; 53/52

(58) Field of Search ..... 53/469, 481, 512, 53/138.3, 284.7, 385.1, 386.1, 52, 70, 448; 493/100, 110, 418, 450

(56) References Cited

U.S. PATENT DOCUMENTS 2,368,624 A * 2/1945 Walton ..... 53/512
3,822,525 A * 7/1974 Anderson et al. ..... 53/512
3,861,983 A * 1/1975 Harrell ..... 156/359
3,874,144 A * 4/1975 Feigel ..... 53/53
3,939,624 A * 2/1976 Gidewall et al. ..... 53/512
4,537,584 A * 8/1985 Everman et al. ..... 493/101
4,912,913 A 4/1990 Rundle
5,457,944 A * 10/1995 Lipes ..... 53/570
5,467,578 A * 11/1995 Jensen ..... 53/572
5,791,123 A * 8/1998 Bolz ..... 53/434
5,802,813 A * 9/1998 Weder ..... 53/435

* cited by examiner

*Primary Examiner*—John Sipos
*Assistant Examiner*—Michelle Lopez
(74) *Attorney, Agent, or Firm*—Marshall, Gerstein & Borun LLP

(57) ABSTRACT

An packaging apparatus and method to uncuff a package assembly is disclosed. The package assembly includes a container with at least one upstanding sidewall defining an open top. A bag is disposed within the container and a top portion of the bag is folded over the at least one sidewall at the open top to define a cuff. The packaging apparatus includes a first fluid jet directed substantially upward that is configured to uncuff the top portion of the bag from the container. An automatic bag closer gathers the top portion of the bag and applies a clip to close the bag. A second fluid jet is directed substantially downward and is configured to push the top portion of the bag substantially within the container.

20 Claims, 7 Drawing Sheets

CONTINUOUS BAG CLOSING APPARATUS AND METHOD

FIELD OF THE DISCLOSURE

The present disclosure relates to a process of closing a bag within a box, and further to a process of uncuffing the bag from the box and closing the bag.

BACKGROUND OF THE DISCLOSURE

Many products of a particulate matter are packaged within a flexible bag. The flexible bag can be inside a supportive container to maintain the shape of the bag and to protect the bag and products during transport to form a package assembly. These products include cat litter, foods, and aggregate, for example.

In the packaging process of the product, it has been found more efficient to place the bag within the supportive container and then fill the bag with the product, rather than vice versa. To ensure the bag stays open while it is being filled with product, the top portion of the bag can be folded over the open top of the container, thereby forming a cuff.

A problem remains in how to quickly and efficiently uncuff the bag from the end of the container and to close the end of the bag while the bag is inside the container. In one known process, the container moves along a conveyor in an assembly line to a first workstation, where it is stopped. At the first workstation, robotic arms pull the top portion upward, thereby uncuffing the bag from the container. The robotic arms are then clapped about the top portion, thereby attempting to gather the top portion together, and push down against the top of the bag, thereby attempting to remove excess air from the bag.

The conveyor then moves the container to a second workstation. A clip applicator gathers the top portion together, and applies a retaining clip to the top portion of the bag, thereby closing the top portion.

The conveyor then moves the container to a third workstation, where the container is again stopped. A second set of robotic arms tamps the bag down such that it is substantially inside the confines of the box.

In this design, the container must be stopped at the workstations while the robotic arms perform their tasks. This slows down the entire process, lowers the output that may be achieved, and can be a bottleneck in the production process. Further, the robotic arms are expensive and require maintenance, repair, and employee training. It would be beneficial to increase the speed of the uncuffing and closing process and would be further beneficial to improve the reliability and cost of the process.

Figure 1:
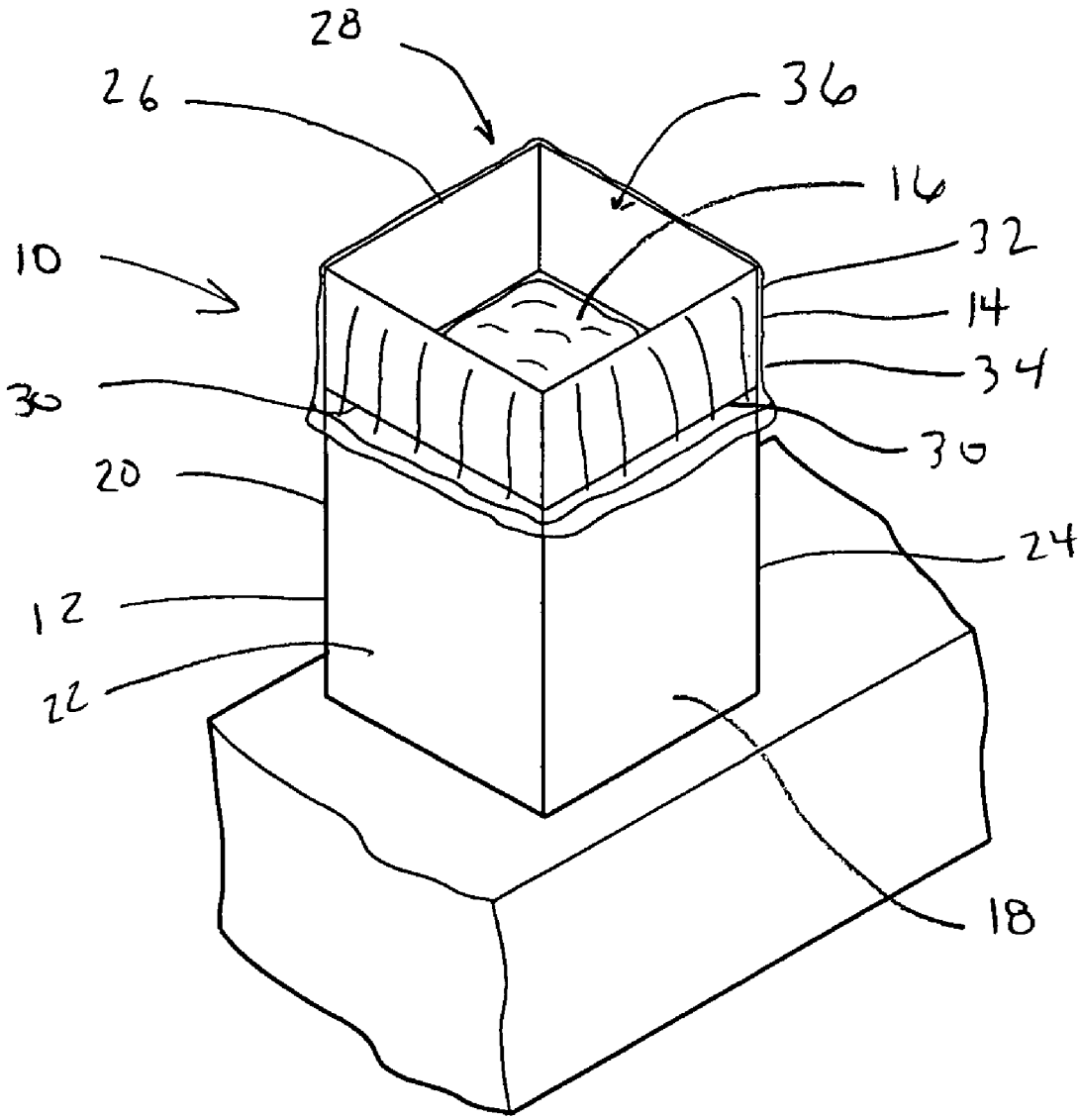
FIG. 1 is a perspective view of a package assembly, prior to the uncuffing process.

While the disclosure is susceptible to various modifications and alternative constructions, certain illustrative embodiments thereof have been shown in the drawings and will be described below in detail. It should be understood, however, that there is no intention to limit the disclosure to the specific forms disclosed, but on the contrary, the intention is to cover all modifications, alternative constructions, and the equivalents falling within the spirit and scope of the invention as defined by the appended claims.

DETAILED DESCRIPTION

Referring now to the drawings, and in particular to FIG. 1, a package assembly 10 is shown. The assembly 10 includes a container 12, a flexible bag 14 disposed within the container 12, and a product 16 disposed within the bag 14. The disclosed container 12 has a left side 18, a right side 20, a front side 22, and a back side 24. However, the container 12 could have any number of sidewalls, including a single cylindrical sidewall. The container 12 includes flaps 26 which are directed upwards to define an open top 28. Each flap 26 is flexible about a respective axis 30 and may be folded downwards and inwards to close the open top 28 of the container 12 once the bag 14 has been uncuffed and closed. While flaps 26 are depicted in FIG. 1, other containers 12 may be used that do not incorporate flaps 26.

The bag 14 includes a top portion 32 that is folded downwards and outward about the flaps 18 to define a cuff 34. The cuff 34 ensures that the bag 14 maintains an open mouth 36 within the container 12 such that the product 16 can easily be dispensed into the bag 14 by a process prior to the disclosed uncuffing and closing process.

The product 16 that can be used in the present uncuffing process is any product that can be stored in an aggregate form in a bag. For example, kitty litter, dog food, sand, rock, flour, or other relatively small pieces that are sold in the aggregate can be used. Alternatively, larger items such as stuffed animals can also be used. Those of ordinary skill in the art will recognize many other products that can be stored and transferred within a bag that is disposed within a container.

Figure 2:
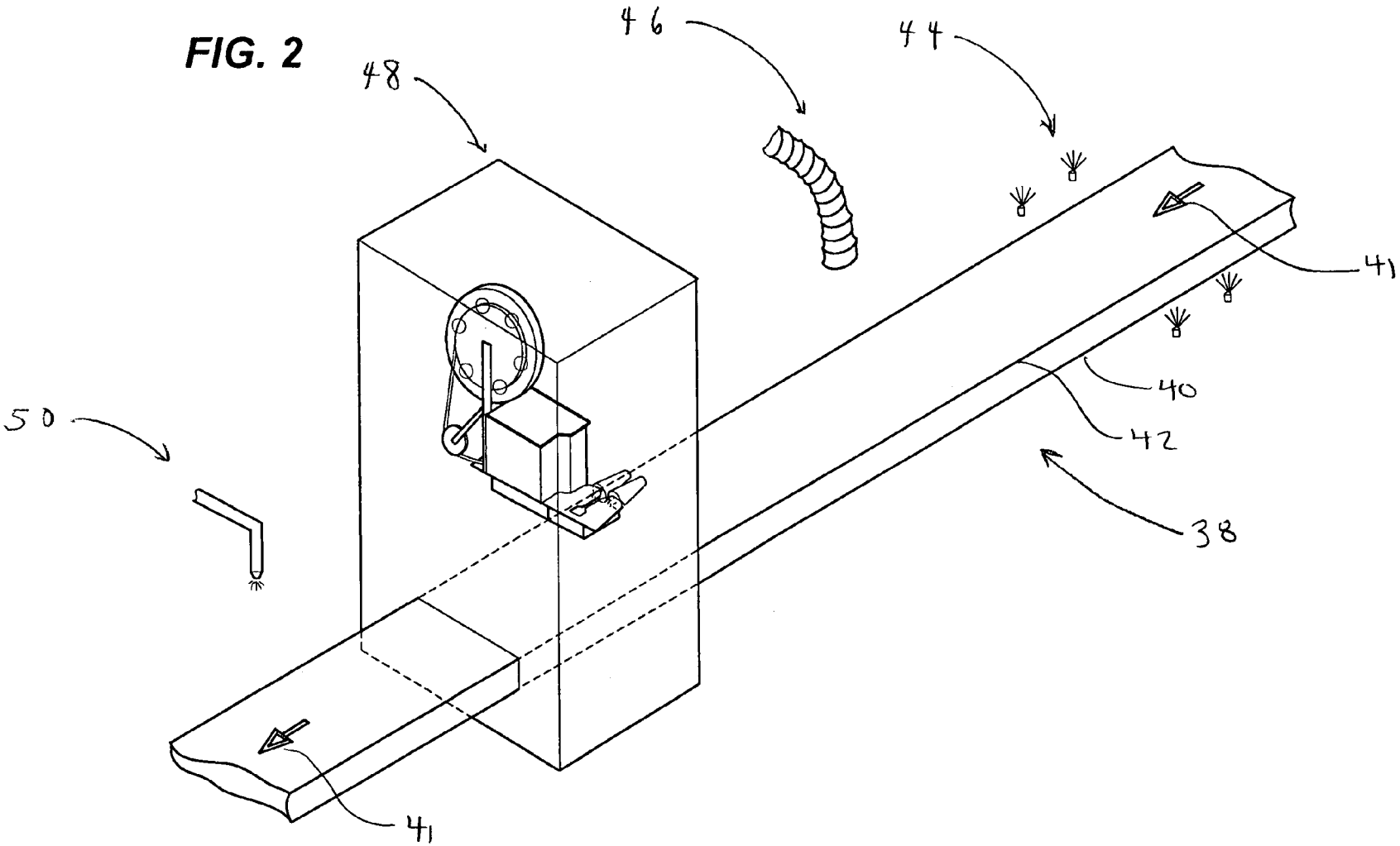
FIG. 2 is a perspective view of a continuous assembly line constructed in accordance with the teachings of this disclosure.

Referring now to FIG. 2, an assembly line 38 is disclosed that can uncuff and close the bag 14 filled with a product 16 while the bag 14 remains within the container 12. The assembly line 38 includes a conveyor 40 which moves the package assembly 10 on a belt 42 in a direction of travel indicated by arrows 41 through a first workstation 44, a second workstation 46, a third workstation 48, and a fourth workstation 50. While four workstations are shown, other workstations may be added that provide additional functions not detailed herein.

At the first workstation 44, the top portion 32 of the bag 14 is uncuffed from the container 12. At the second workstation 46, excess air is removed from the bag 14. At the third workstation 48, the top portion 32 of the bag 14 is gathered and closed. Finally, at the fourth station 50, the bag 14 is pushed back down into the container 12.

Figure 3:
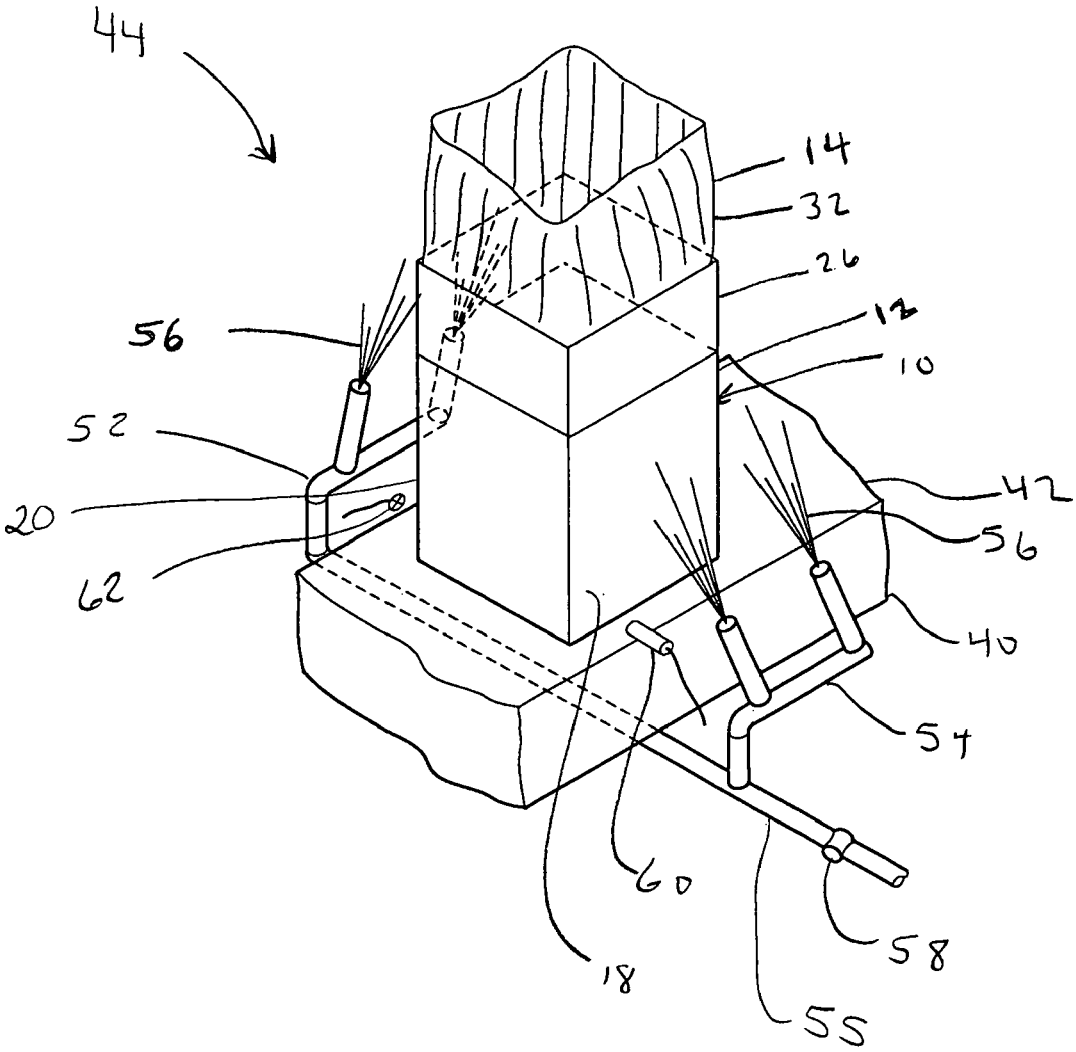
FIG. 3 is a perspective view of the package assembly at the first station of the assembly line of FIG. 2.

Referring now to FIG. 3, a detail of the first workstation 44 is shown. The first workstation 44 includes a first pair of fluid jets 52 and a second pair of fluid jets 54 at the end of an fluid line 55. The fluid jets 52, 54 are capable of delivering a blast of fluid 56 and are controlled by a valve 58. While in this example all four fluid jets 52, 54 are fed by the same valve 58, those skilled in the art will easily understand that more complex arrangements can be used depending on the application.

In this disclosure, the term fluid is used in the engineering sense and refers to both gas and liquid. In this example, the working fluid 56 is compressed air. Other situations, however, could require another gas, such as an inert gas like helium, in a situation in which flammability could pose a problem. Still other situations may require a larger force that could be applied by a liquid such as water. Other uses are within the scope of this disclosure.

The air jets 52, 54 can be controlled by articles known in the art. In this example, a laser 60 and an electronic eye 62 are disposed adjacent the path of the conveyor 40. As is known, the laser 60 is set up such that its light beam is directed into the electronic eye 62. If the light beam is blocked, the electronic eye 62 sends a signal to a programmable logic controller (not shown). The PLC then sends a signal to the valve 58 to open and allow the compressed air 56 to be expelled through the air jets 52, 54. The valve 58 can remain open for a programmed amount of time, or can remain open for as long as the light beam is blocked. Other controls for the air jets 52, 54, such as limit switches and proximity switches can be used.

In this example, the package assembly 10 can be moved continuously along by the conveyor 40 through the first workstation 44. As the package assembly 10 is moved through the first workstation 44, the container 12 of the package assembly 10 blocks the laser beam. The electronic eye 62 signals the PLC, which signals the air valve 58 to open.

The air jets 52, 54 expel high pressure fluid 56 upwards and along the left and right sides 18, 20 of the container 12 as it passes by. This high pressure fluid 56 forces the top portion 32 of the bag 14 upward, thereby uncuffing the bag 14 from the container 12. The natural rigidity of the bag 14 helps the top portion 32 to remain in an extended position as shown in FIG. 3.

In this example, a pair of air jets 52, 54 are depicted on the left and right side 18, 20 of the container 12. Depending on the application, more or less air jets 52, 54 may be necessary. Further, if the conveyor 40 includes an open chain conveyor belt 42, air jets can be disposed underneath the conveyor 40 such that an air blast will travel from under and through the conveyor belt 42 and hit the front and back sides 22, 24 of the container 12. This could thereby provide an air force on all four sides of the container 12.

Figure 4:
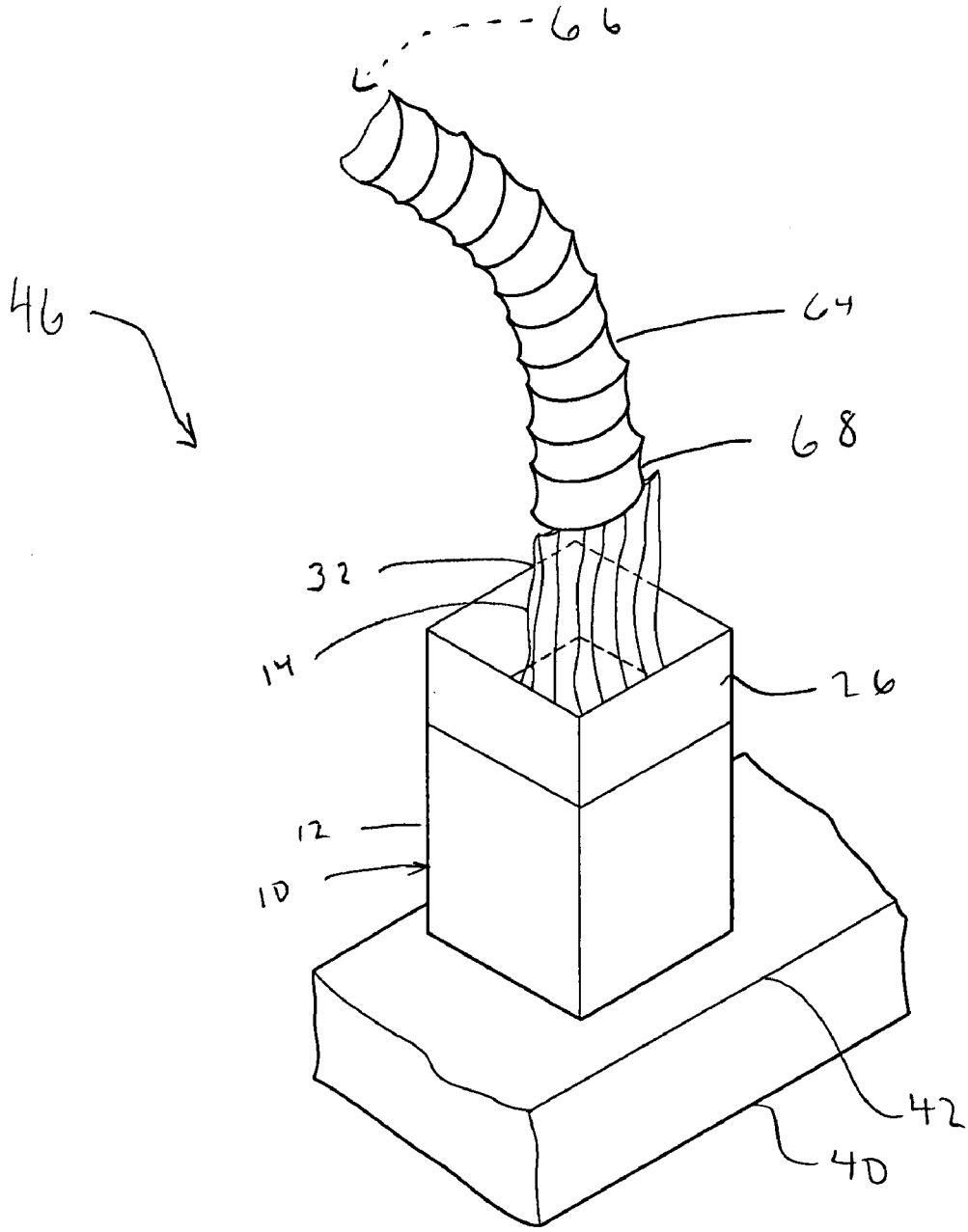
FIG. 4 is a perspective view of the package assembly at the second station of the assembly line of FIG. 2.

Referring now to FIG. 4, the second workstation 46 includes a hose 64 with a distal end 66 and a proximal end 68. A vacuum motor (not shown) connected to the distal end 66 of the hose 64 creates a low pressure within the hose 64 such that air adjacent the proximal end 68 of the hose 64 is sucked into and through the hose 64 to the vacuum motor.

The package assembly 10 is moved continuously by the conveyor 40 underneath the proximal end 68 of the hose 64. Because the bag 14 is in the extended position as it is moved under the proximal end 68 of the hose 64, air is sucked from inside the bag 14 into the hose 64, i.e., the air is removed from the bag 14, and the bag 14 collapses about the product 16.

The pressure differential created by the vacuum motor must be selected to be strong enough to remove the air from inside the bag 14, but not too strong so as to remove the product 16 from the bag 14. As such, the pressure must be selected based on the properties of the individual pieces of product 16. The inherent rigidity of the bag 14 can maintain the bag 14 in a collapsed state about the product 16 with the top portion 32 of the bag 14 still extending upward. The package assembly 10 can be moved continuously through the second workstation 46 and on to the third workstation 48.

Figure 5:
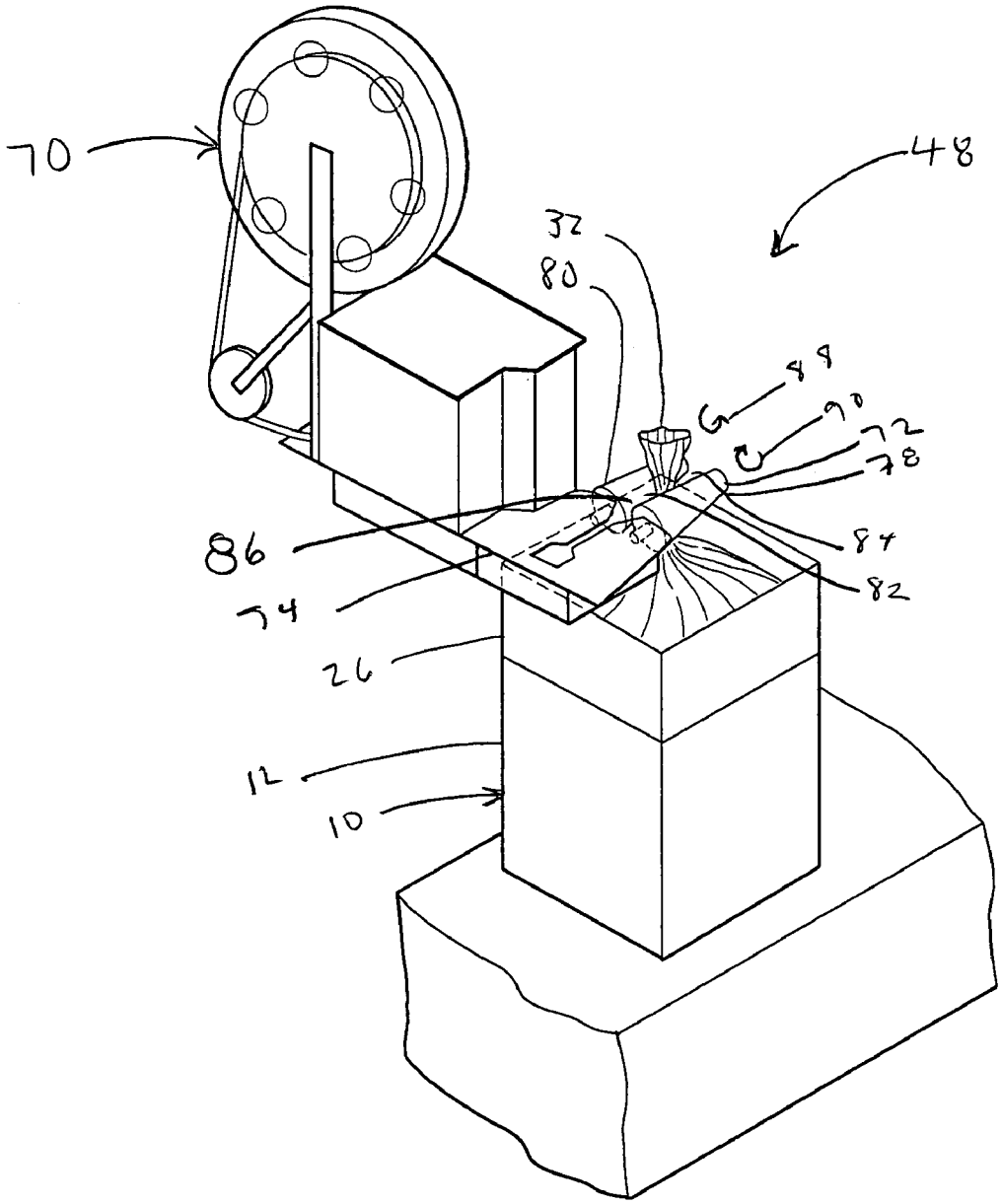
FIG. 5 is a perspective view of the package assembly at the third station of the assembly line of FIG. 2.
Figure 6:
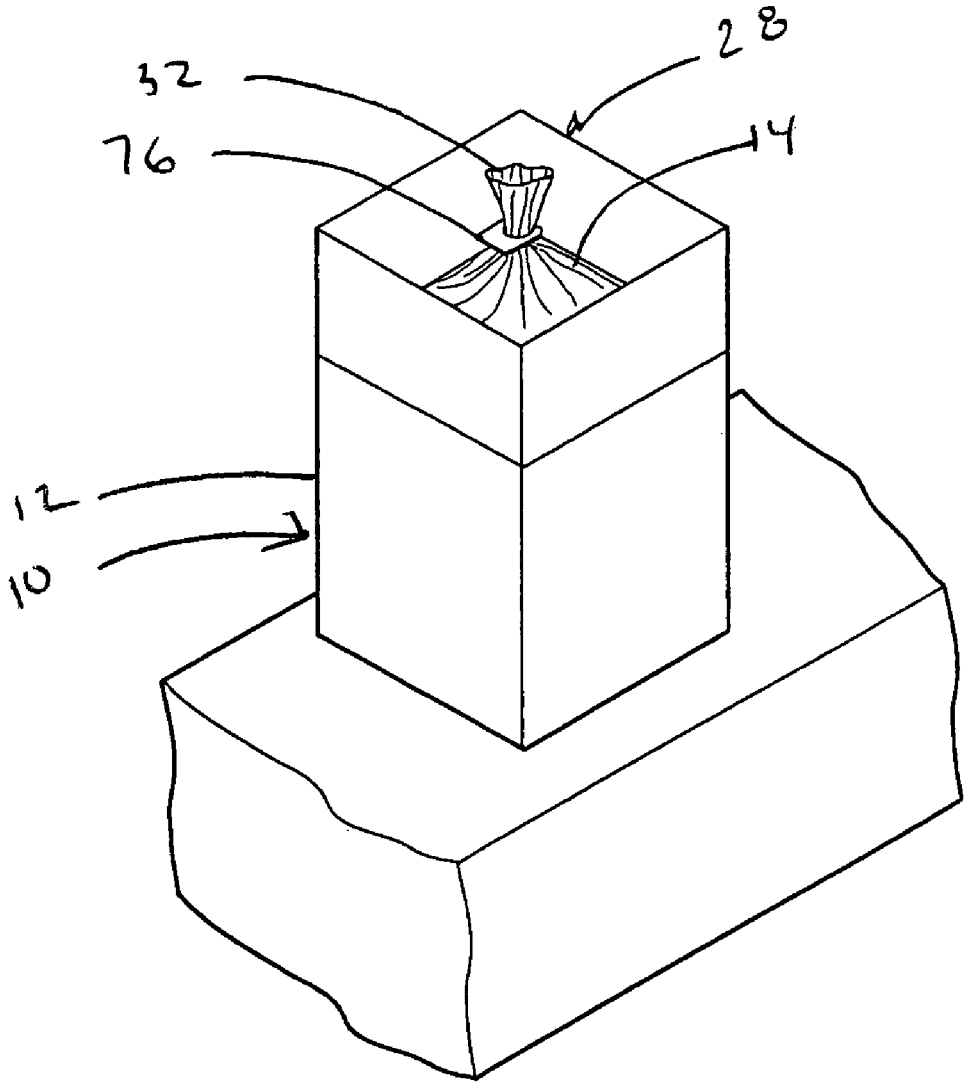
FIG. 6 is a perspective view of the package after being closed at the third station of the assembly line of FIG. 2.

Referring now to FIGS. 5 and 6, the third workstation 48 is shown. The third workstation 48 includes an automatic bag closing machine 70 which includes a bag gathering portion 72 and a clip applicator 74. The automatic bag closing machine 70 depicted herein is manufactured by Kwik-Lok, Model No. 865. While the depicted automatic bag closing machine 70 has proven to be sufficient, any system that performs the similar function of gathering the top portion 32 of the bag 14 and closing the bag, such as with a retaining clip 76, could be employed. This could encompass heat sealing, closing a plastic zipper, applying twist tie closures, or even a human on an assembly line twisting the top portion 32 closed and tying it.

The bag gathering portion 72 includes a first conical roller 78 and a second conical roller 80. A passage 82 is defined between the first conical roller 78 and the second conical roller 80. The passage 82 includes a wide entrance 84 that tapers to a narrow exit 86. In this example, the first roller 78 rotates in a first direction 88, and the second roller 80 rotates in an opposite second direction 90 such that both rollers 78, 80 are rotating upwards in the passage 82.

As the package assembly 10 travels along the conveyor 40, the top portion 32 is gathered in and passes through the wide entrance 84. As the top portion 32 is engaged by the first and second rollers 78, 80, it is drawn upward by the rotation of the first and second rollers 78, 80. The bag 14 travels through the passage 82 and the narrow exit 86 and is thereby prepared for the clip applicator 74.

As is known in the art, the clip applicator 74 applies a retaining clip 76 to the top portion 32 of the bag 14. Clip applicators 74 are well known and used in the closing of bags containing, for example, bread, fruit, vegetables, and other products. This closes the bag to maintain the product within the bag until a user pulls the retaining clip 74 from the bag 14. Due to the rigidity of the bag 14, the top portion 32 of the bag 14 can be maintained in the extended position upon leaving the third workstation 48, as seen in FIG. 6. The package assembly 10 can be moved continuously through the third workstation 48 and on to the fourth workstation 50.

Figure 7:
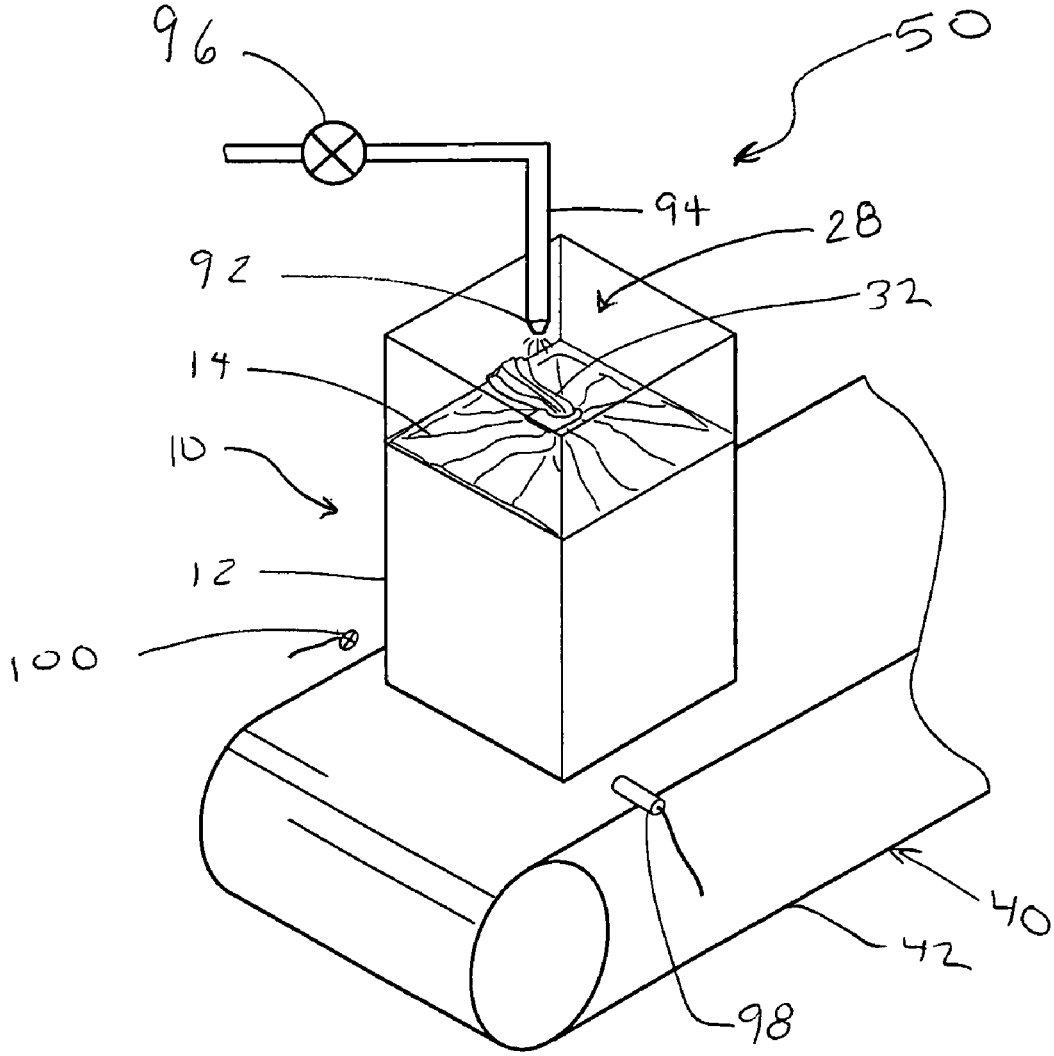
FIG. 7 is a perspective view of the package assembly at the fourth station of the assembly line of FIG. 2.

Referring now to FIG. 7, the fourth workstation 50 is shown. The fourth workstation 50 includes a fluid jet 92 at an end of a fluid line 94 that is controlled by a valve 96. The fluid jet 92 is directed downward. Again, the term fluid is used in its engineering sense to encompass both gas and liquid. In this example, compressed air is again used.

The air jet 92 can be controlled by articles known in the art. In this example, a second laser 98 and a second electronic eye 100 are used in the same manner as in the first work station 44. Again, other controls for the air jet 92, such as limit switches and proximity switches can be used, and other methods and articles for sensing the package assembly 10 will be known by those in the art.

The package assembly 10 can be moved continuously along by the conveyor through the fourth workstation 50. As the package assembly 10 is moved past the fourth workstation 50, the light beam is broken and the second electronic eye 100 sends a signal to the PLC, which then sends a signal to the second valve 96. The second valve 96 opens and compressed air is released to travel through the air jet 92 downward against the top portion 32 of the bag 14. The compressed air forces the top portion 32 of the bag 14 from its extended position downward into the container 12 such that the entire bag 14 is substantially inside the container 12. While a compressed air jet 92 is depicted, other methods to push the top portion 32 into the container 12, such as a ram pushing down on the top portion 32, can be used. The package assembly 10 is now ready for steps in which the flaps 26 are folded down and in and the open top 28 of the container 12 is closed.

The package assembly 10 can move continuously on the conveyor 40 through all the workstations 44, 46, 48, 50 to define an assembly line 38 that can be continuous throughout its entire process. In this manner, a bag 14 filled with a product 16 that has a top portion 32 folded over the open top 28 of the container 12 can quickly, inexpensively, and efficiently be uncuffed and closed.

The conveyor 40 can have an adjustable speed for fine tuning the operation of the assembly line 38. For example, larger bags or bags with thicker walls may require an air blast for a longer period of time than smaller bags or bags with thinner walls. Accordingly, depending on the application, the speed of the conveyor 40 may be increased or decreased.

It has been found that when using a bag with a wall thickness of 1.5 mil and with a width of 22½", the fluid jets can be regulated to 70–75 psi. However, differently sized bags may require higher or lower air pressure, further depending on the placement of the fluid jets relative to the conveyor. It is within the scope of this disclosure and the ordinary skill of one in the art for bags and fluid jets with a variety of parameters to be used.

From the foregoing, one of ordinary skill in the art will appreciate that the present disclosure sets forth a process for uncuffing a bag and closing the bag within a container. However, one of ordinary skill in the art could readily apply the teachings of this disclosure to any number of situations. As such, the teachings of this disclosure shall not be considered to be limited to the specific examples disclosed herein, but to include all applications within the spirit and scope of the invention.

We claim:

1. A process for uncuffing and closing a package assembly, the package assembly including a container with at least one upstanding sidewall defining an open top, a bag disposed within the container, a top portion of the bag being folded over the at least one sidewall at the open top of the container to define a cuff, the process comprising:

propelling a first fluid upward along the at least one sidewall of the container to uncuff the bag and extend the top portion of the bag upward;

closing the top portion of the bag; and pushing the top portion of the bag substantially within the container; wherein the pushing step includes propelling a second fluid downward onto the bag.

2. The process of claim 1, further comprising suctioning the excess air from inside the bag.

3. The process of claim 2, wherein the suctioning step includes applying the open end of a hose with an interior low pressure to the top portion of the bag.

4. The process of claim 1, wherein the closing step further comprises:

gathering a section of the top portion; and applying a clip to the section.

5. The process of claim 4, wherein the gathering step comprises:

directing the top portion between a pair of rotating cones.

6. The process of claim 1, wherein the propelling of the first fluid includes propelling a jet of air.

7. The process of claim 6, further comprising opening a valve to propel the first fluid upward.

8. The process of claim 7, further comprising blocking a light beam to open the valve.

9. The process of claim 1, further comprising propelling a first fluid upward along two opposite sidewalls of the container.

10. A packaging apparatus configured to uncuff a package assembly, the package assembly including an open-topped container, the container including at least one upstanding sidewall, and a bag disposed within the container, a top portion of the bag being folded over the at least one sidewall of the container at the open top to create a cuff, the packaging apparatus comprising:

a first fluid jet directed substantially upward and configured to uncuff the top portion of the bag from the container;

means for closing the bag; and a second fluid jet directed substantially downward and configured to push the top portion of the bag substantially within the container.

11. The apparatus of claim 10, wherein the first fluid jet and the second fluid jet are air jets.

12. The apparatus of claim 10, further comprising a conveyor for transporting the packaging assembly.

13. The apparatus of claim 10, further comprising a suction hose adapted to remove the excess air from the bag.

14. The apparatus of claim 10, wherein the means for closing the bag include a pair of rotating cones adapted to gather the top portion.

15. The apparatus of claim 14, wherein the means for closing the bag further include means for applying a clip to the top portion.

16. The apparatus of claim 10, further comprising a valve adapted to regulate the flow of fluid to the first fluid jet.

17. The apparatus of claim 10, further comprising a first electronic eye adapted to determine the location of the package assembly.

18. The apparatus of claim 17, further comprising a laser directed at the first electronic eye.

19. A method of continuously uncuffing and closing a package assembly, the package assembly including a container with at least one upstanding sidewall defining an open top, and a flexible bag disposed within the container, a top portion of the bag being folded over the at least one sidewall at the open top of the container to define a cuff, the method comprising:

directing the container and bag continuously through a plurality of workstations along a conveyor;

propelling a first fluid upward along the at least one sidewall of the container to uncuff the bag and extend the top portion of the bag upward;

closing the top portion of the bag; and propelling a second fluid downward onto the bag to push the top portion of the bag substantially within the container.

20. The method of claim 19, further comprising suctioning air from inside the bag.

* * * * *